US008535091B2

(12) United States Patent
Fu et al.

(10) Patent No.: US 8,535,091 B2
(45) Date of Patent: Sep. 17, 2013

(54) FIXING APPARATUS FOR CONNECTOR

(75) Inventors: Li-Ren Fu, Shenzhen (CN); Jun-Hui Wang, Shenzhen (CN); Ai-Ling He, Shenzhen (CN)

(73) Assignees: Hong Fu Jin Precision Industry (ShenZhen) Co., Ltd., Shenzhen (CN); Hon Hai Precision Industry Co., Ltd., New Taipei (TW)

( * ) Notice: Subject to any disclaimer, the term of this patent is extended or adjusted under 35 U.S.C. 154(b) by 86 days.

(21) Appl. No.: 13/271,253

(22) Filed: Oct. 12, 2011

(65) Prior Publication Data

US 2013/0052862 A1 Feb. 28, 2013

(30) Foreign Application Priority Data

Aug. 23, 2011 (CN) ..... 2011 1 0242826

(51) Int. Cl.
*H01R 13/73* (2006.01)

(52) U.S. Cl.
USPC ..... 439/573; 439/545

(58) Field of Classification Search
USPC ..... 439/573, 571, 544, 545
See application file for complete search history.

(56) References Cited

U.S. PATENT DOCUMENTS

| | | | | |
|---|---|---|---|---|
| 6,346,007 | B2 * | 2/2002 | Yokoi | 439/564 |
| 6,773,286 | B1 * | 8/2004 | Wu | 439/247 |
| 6,945,816 | B1 * | 9/2005 | Wu | 439/545 |
| 7,597,587 | B1 * | 10/2009 | Duesterhoeft | 439/545 |
| 7,607,930 | B1 * | 10/2009 | Wu | 439/247 |

* cited by examiner

*Primary Examiner* — Hien Vu
(74) *Attorney, Agent, or Firm* — Altis Law Group, Inc.

(57) ABSTRACT

A fixing apparatus for a connector includes a fixing plate and a fastener. The connector includes a main body, a block protruding from the main body, a connecting portion protruding from the block, and two protrusions respectively extending from opposite sides of the block. The fixing plate defines an opening, two notches communicating with the opening, and a positioning hole. The fastener is mounted to the main body of the connector and includes a slidable shaft. When the connecting portion and the block are extended through the opening, the protrusions are respectively extended through the notches, and the main body engages with a rear surface of the fixing plate. The connector is capable of sliding along the opening, to allow the protrusions to engage with a front surface of the fixing plate, and to allow the shaft to engage in the positioning hole.

4 Claims, 4 Drawing Sheets

FIXING APPARATUS FOR CONNECTOR

BACKGROUND

1. Technical Field

The present disclosure relates to an apparatus for fixing a connector.

2. Description of Related Art

In an electronic device, some connectors, such as serial advanced technology attachment (SATA) connectors, are mounted to a sidewall of an enclosure of the electronic device with screws. However, those screws are usually small and difficult to handle, and the installation of the connectors in the computer is tedious.

BRIEF DESCRIPTION OF THE DRAWINGS

Many aspects of the present embodiments can be better understood with reference to the following drawings. The components in the drawings are not necessarily drawn to scale, the emphasis instead being placed upon clearly illustrating the principles of the present embodiments. Moreover, in the drawing, all the views are schematic, and like reference numerals designate corresponding parts throughout the several views.

DETAILED DESCRIPTION

The disclosure, including the accompanying drawings, is illustrated by way of example and not by way of limitation. It should be noted that references to "an" or "one" embodiment in this disclosure are not necessarily to the same embodiment, and such references mean at least one.

Figure 1:
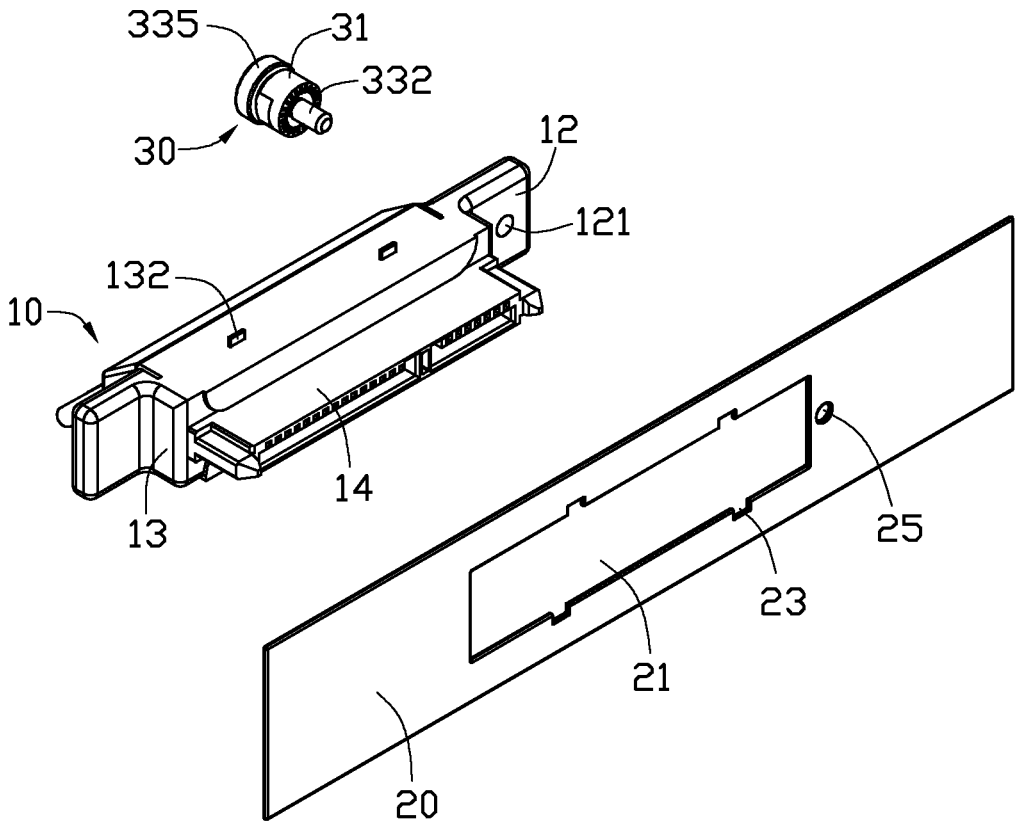
FIG. 1 is an exploded, isometric view of an exemplary embodiment of a fixing apparatus together with a connector, wherein the fixing apparatus includes a fastener.
Figure 2:
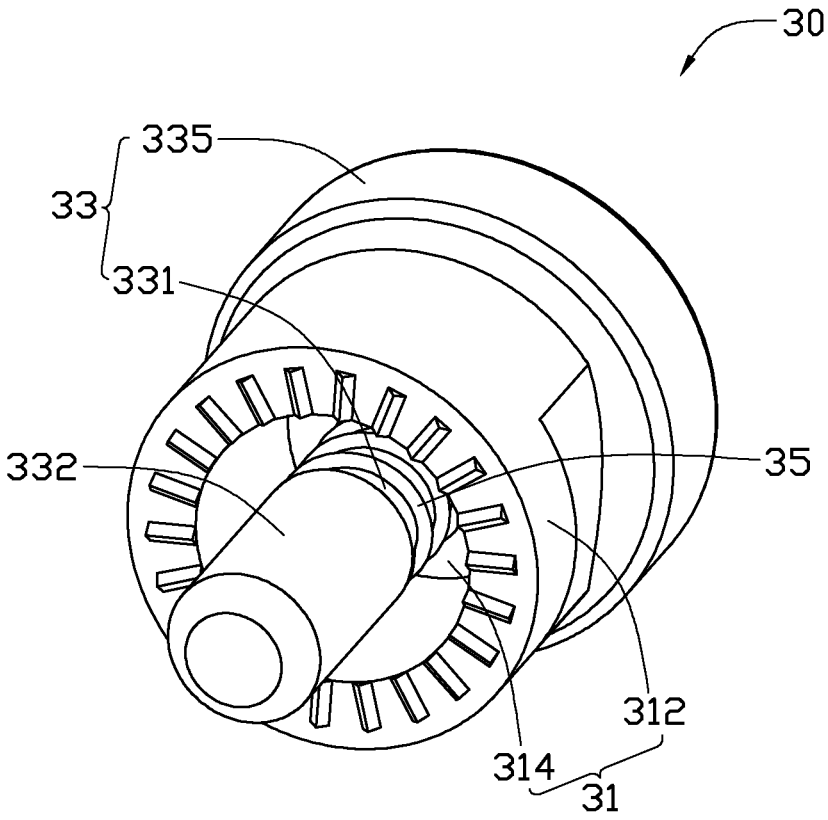
FIG. 2 is an enlarged view of the fastener of FIG. 1, but viewed from another perspective.
Figure 4:
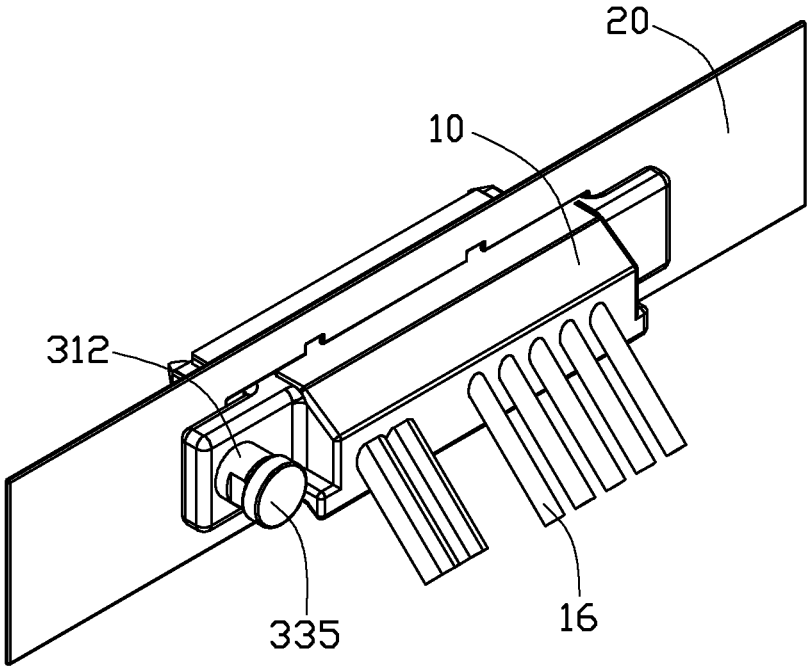
FIG. 4 is similar to FIG. 3, but viewed from another perspective.

Referring to FIGS. 1, 2, and 4, an exemplary embodiment of a fixing apparatus is provided to fix a connector 10. The fixing apparatus includes a fixing plate 20 and a fastener 30 mounted to the connector 10.

The connector 10 includes a substantially rectangular main body 12, a block 13 protruding from the front surface of the main body 12, a connecting portion 14 protruding from the front surface of the block 13, and a plurality of cables 16 connected to the rear side of the main body 12. A through hole 121 is defined in the main body 12 adjacent to an end of the block 13. Two spaced protrusions 132 extend up from the top of the block 13, and two spaced protrusions 132 extend down from the bottom of the block 13.

The fixing plate 20 is a part of a sidewall of an electronic device enclosure. A substantially rectangular opening 21 is defined in the fixing plate 20. Two notches 23 are defined in the fixing plate 20 communicating with the top side of the opening 21, and two notches 23 are defined in the fixing plate 20 communicating with the bottom side of the opening 21. A positioning hole 25 is defined in the fixing plate 20 adjacent to an end of the opening 21.

The fastener 30 includes a mounting member 31, a latching member 33 slidably connected to the mounting member 31, and a resilient member 35. In the embodiment, the resilient member 35 is a compression spring. The mounting member 31 includes a substantially cylindrical sleeve 312, and an end wall 314 covering the rear end of the sleeve 312. A through slot (not shown) is defined in a middle of the end wall 314. The latching member 33 includes a shaft 331, and an operation portion 335. The shaft 331 includes a latching portion 332 on the front end of the shaft 331. A diameter of a cross section of the latching portion 332 is greater than a diameter of a cross section of the other part of the shaft 331. The rear end of the shaft 331 is extended through the resilient member 35, the sleeve 312, and the through slot of the end wall 314, and engages with the operation portion 335 outside the end wall 314. The resilient member 35 is received in the sleeve 312, with opposite ends of the resilient member 35 abutting against the latching portion 332 and the inner side of the end wall 314, respectively.

The front end of the sleeve 312 is fixed to the rear side of the main body 12, with the latching portion 332 aligning with the through hole 121. In an original status, the front end of the latching portion 332 is extended through the through hole 121 and exposed out of the front surface of the main body 12 under a resilient force of the resilient member 35. In the embodiment, the main body 12 is made of plastic, and the sleeve 312 is made of metal, the sleeve 312 is fixed to the rear side of the main body 12 by hot melt. In other embodiments, the sleeve 312 may be fixed to the main body 12 by latches of threaded portions.

Figure 3:
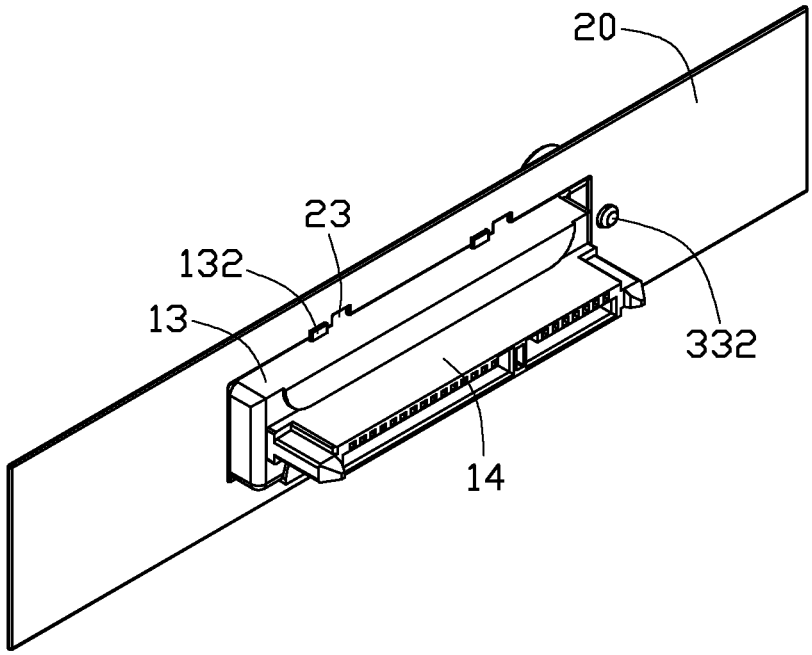
FIG. 3 is an assembled, isometric view of FIG. 1.

Referring to FIGS. 3 and 4, in assembly, the connector 10 is placed behind the fixing plate 20, to allow the four protrusions 132 to respectively align with the four notches 23, and to allow the latching portion 332 to be arranged adjacent to the positioning hole 25. The connector 10 is moved forwards. The connecting portion 14 and the block 13 are extended through the opening 21, and the protrusions 132 are extended through the notches 23, respectively. The main body 12 engages with the rear surface of the fixing plate 20. The latching portion 332 abuts against the fixing plate 20 and is moved backwards. The resilient member 35 is deformed. The connector 10 is longitudinally slid along the opening 21, to allow the latching portion 332 to move towards the positioning hole 25, and to allow the protrusions 132 to stagger with the corresponding notches and engage with the front surface of the fixing plate 40. When the latching portion 132 aligns with the positioning hole 25, the resilient member 35 is restored to push the latching portion 332 to move forwards and engage in the positioning hole 25. Thereby, the connector 10 is fixed to the fixing plate 20.

To detach the connector 10 from the fixing plate 20, the operation portion 335 is pulled backwards, to allow the latching portion 332 to disengage from the positioning hole 25. The connector 10 is slid, to allow the protrusions 132 to move towards the corresponding notches 23. When the protrusions 132 respectively align with the notches 23, the connector 10 is moved backwards to be detached from the fixing plate 20.

Even though numerous characteristics and advantages of the embodiments have been set forth in the foregoing description, together with details of the structure and the functions of the embodiments, the disclosure is illustrative only, and changes may be made in details, especially in matters of shape, size, and arrangement of parts within the principles of the embodiments to the full extent indicated by the broad general meaning of the terms in which the appended claims are expressed.

What is claimed is:

1. A fixing apparatus for an electrical connector, the electrical connector comprising a main body, a block protruding from a front surface of the main body, a connecting portion protruding from a front surface of the block, and two protrusions respectively extending upwardly from opposite sides of the block, the fixing apparatus comprising:

a fixing plate defining an opening, two notches respectively communicating with opposite sides of the opening, and a positioning hole; and a fastener to be mounted to the main body of the connector, the fastener comprising a shaft slidable in a first direction perpendicular to the fixing plate, wherein when the connecting portion and the block of the connector are extended through the opening, the protrusions are respectively extended through the notches, and the main body engages with a rear surface of the fixing plate, the connector is capable of being slid along the opening in a second direction perpendicular to the first direction, to allow the protrusions to stagger with the corresponding notches and engage with a front surface of the fixing plate, and to allow the shaft to engage in the positioning hole;

wherein the fastener further comprises a mounting member and a resilient member, the mounting member is to be fixed to the main body of the connector, the shaft is slidably extended through the mounting member; and wherein the mounting member comprises a sleeve, and an end wall covering a rear end of the sleeve, the shaft is slidably extended through the sleeve and the end wall and comprises a latching portion on a front end of the shaft away from the end wall, a diameter of a cross section of the latching portion is greater than a diameter of a cross section of the other part of the shaft, the resilient member is fitted around the shaft and sandwiched between the latching portion and the end wall; the shaft is slid toward the end wall to deform the resilient member, and the resilient member is then restored and forces the latching portion to move forward to engage in the positioning hole.

2. The fixing apparatus of claim 1, wherein the fastener further comprises an operation portion, and a rear end of the shaft is extended out of a rear surface of the end wall and connected to the operation portion.

3. The fixing apparatus of claim 1, wherein a front end of the sleeve is connected to a rear side of the main body, a through hole is defined in the main body, and the front end of the shaft is extended through the through hole of the main body under the force of the resilient member.

4. The fixing apparatus of claim 3, wherein the main body is made of plastic, and the sleeve is made of metal, the sleeve is fixed to the rear side of the main body by hot melt.

* * * * *